US005344158A

United States Patent [19]

Gridley

[11] Patent Number: 5,344,158

[45] Date of Patent: Sep. 6, 1994

[54] MARTIAL ART THROWING AND HAND WEAPON

[76] Inventor: Lance E. Gridley, 13473 W. Oregon Ct., Lakewood, Colo. 80228

[21] Appl. No.: 181,014

[22] Filed: Jan. 14, 1994

[51] Int. Cl.[5] ..... A63B 65/02

[52] U.S. Cl. ..... 273/419; 30/366; 30/298; D22/115; D22/118

[58] Field of Search ..... 273/416, 419–422; 30/298, 164.5–164.8, 366–368; D22/115, 117, 118

[56] References Cited

U.S. PATENT DOCUMENTS

| | | | |
|---|---|---|---|
| D. 301,048 | 5/1989 | Hollinshead | D22/118 |
| 692,196 | 1/1902 | Espinosa | 30/298 X |
| 1,260,226 | 3/1918 | Maker | 30/366 X |
| 2,109,120 | 2/1938 | Price | 273/420 |
| 2,179,404 | 11/1939 | Fabionar | 273/420 |
| 2,490,470 | 12/1949 | Racine | 273/416 X |
| 3,772,781 | 11/1973 | Newman | 273/420 X |
| 4,765,628 | 8/1988 | Jensen | D22/117 X |
| 5,197,745 | 3/1993 | Whiteley | 273/420 |

FOREIGN PATENT DOCUMENTS

| | | | |
|---|---|---|---|
| 543790 | 7/1957 | Canada | D22/L273 117 |
| 379828 | 8/1964 | Switzerland | 30/298 |

OTHER PUBLICATIONS

Guns & Ammo, Oct. 1979 p. 98 Bowen Knife Co. Ad.

*Primary Examiner*—Paul E. Shapiro
*Attorney, Agent, or Firm*—Charles C. Corbin

[57] ABSTRACT

A martial arts throwing and hand-held weapon that has a generally oblong frame that includes parallel opposite side members, a rear bar that connects rearward ends of the side members, and a pair of oblique front members that converge from forward ends of the side members to an apex from which extends forwardly a pointed weapon tip.

12 Claims, 1 Drawing Sheet

MARTIAL ART THROWING AND HAND WEAPON

BACKGROUND OF THE INVENTION

1. Field of the Invention

The present invention relates to martial arts/defensive weapons that can be used as hand propelled projectiles as well as hand-held close range weapons. More particularly, the present invention relates to such a weapon having a single longitudinally extending point, and which is adapted to be projected through the air in point-first flight involving rotation about its longitudinal axis.

2. Description of the Prior Art

In the martial arts/self-defense world, hand-held and hand-propelled weapons (i.e. non-firearm, non-archery weapons) are sometimes classified by their respective fighting range. For example, knives and nunchuku are for close range, spears and staffs are for mid-range, and various throwing weapons, such as throwing stars, are for long-range use.

There has always been a desire to devise a weapon that could be effective and accurate at all these ranges. For example, knives which are notoriously hand-held, short range weapons, have been thrown in an attempt to expand them into the mid to long ranges, but, as is well known to the professional knife thrower, there are drawbacks inherent to the throwing knife. The major limitation stems from the end-over-end rotation of the throwing knife which dictates that it cannot be thrown at any random distance from an intended target—the distance must be measured in rotations. Thus the knife thrower must always contend with judging the rotation of the knife to a given target—a difficult task and one that is compounded when the target is moving. Additionally, it is noted that a knife that is specifically designed for throwing (i.e. balanced), usually has limited use as a close-range fighting weapon.

One type of hand-propelled weapon that avoids the rotational problems of the throwing knife is the throwing star, also known as the Chinese Star. These weapons are characterized by a circumferential array of multiple pointed tips, and are thrown in the fashion of flying discs. Unfortunately, years of dedication are required to learn to throw a star with power and accuracy. Another drawback with stars as a long-range weapon is the limited and minimal penetration of a target because of the relative small size of its points. Attempts have been made to make throwing stars function in close range combat, but they have limited use as a hand-to-hand fighting weapon because of their multiple points make it quite difficult to hold in hand. U.S. Pat. No. 4,765,628 shows a multi-tipped ring-shaped throwing weapon that is proposed as an improvement over the conventional throwing star, however, like the throwing star this weapon apparently does not lend itself to be effectively used as a hand-held weapon.

Another hand-propelled throwing projectile which may overcome some of the rotational problems of the throwing knife is shown in the U.S. Pat. No. 2,490,470. This U-shaped projectile for a game has a pair of spaced-apart, sharpened tips, and can be thrown such that it's tips remain foremost during its flight path, rotation occurring about a longitudinal axis. Despite this one advantage, it is noted that the effectiveness such a device is limited by the fairly rapid rotation of the dual tips in a circle during flight. Such device is also limited by the spreading of the device's striking force over two tips, thereby reducing the penetrating power of each tip, and by the fact that such designs do not lend themselves to be hand-held for close-range combat.

SUMMARY OF THE INVENTION

In view of the foregoing, it is a general object of the present invention to provide a hand-held/hand-propelled martial arts weapon that is highly effective for close-range, mid-range and long-range use.

Another object of the invention is to provide such a weapon that can be used as a throwing weapon which revolves about its longitudinal axis during flight, for effective use as a thrown weapon at any range.

Another object is to provide such a throwing weapon which can be thrown with accuracy and consistency after a relatively short period of practice time.

Still another object of the invention is to provide such a weapon that is single-tipped.

Yet another object is to provide such a weapon that, as a hand-held device, shields the users fighting hand from an attacker's attempts at knocking it from one's grasp.

A further object of the invention is to provide such a device that incorporates airfoil structure that can generate a propeller effect as it rotates during flight.

Finally, it is an object of the invention to provide such a weapon that offers a stable, secure, comfortable and protective hand-grasp for close-range use.

These and other objects and advantages can be obtained by the present invention of a martial arts throwing and hand-held weapon that includes an oblong bar frame that has a pair of spaced-apart parallel side members, and an integral rear bar that connects rear ends of the two side members, this rear portion being curved or straight and suited for being comfortably abutted against the palm of the users' hand. The frame has a forward portion comprising a pair of oblique bars that converge from front ends of the two side bars to an apex. There is a central stem extending forwardly from the apex, and a pointed weapon head that is removably secured to the stem in a preferred embodiment, extends forwardly from the stem. The weapon also includes a cross member spaced forwardly of the rear of the frame. The spacing between side members is sufficient to admit the user's fingers so that the cross member can be grasped by one's fingers as the rear bar of the frame is engaged in the palm of the hand for secure, stable and protective holding of the weapon for short-range use as a defensive weapon. In one variant of the invention the front edge of the cross member is contoured for receiving the user's fingers. In another variant of the invention each of the converging forward members is a blade having a sharpened outer edge. In yet another variant the converging forward members and/or the cross member have an airfoil configuration such that a forward propelling effect is achieved when the device rotates about its longitudinal axis.

DETAILED DESCRIPTION OF THE INVENTION

Figure 1:
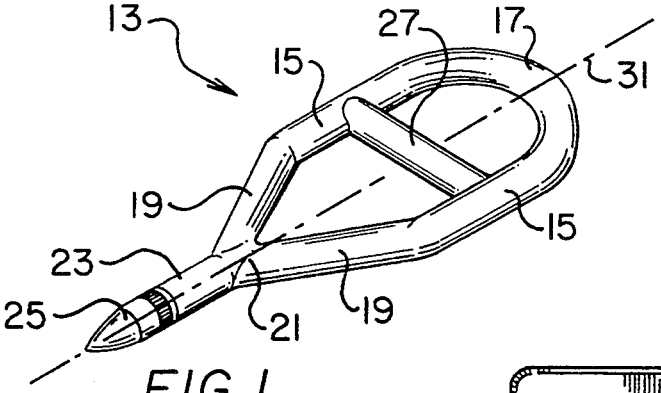
FIG. 1 is a perspective view illustrating a preferred embodiment of a martial arts weapon according to the present invention.

Referring now to the drawings, FIG. 1 shows one preferred embodiment of a martial arts weapon 13 according to the present invention. Device 13, like other variants of the invention, to be described, is preferably constructed of steel using conventional metal working techniques. Device 13 is primarily fabricated of rod material having a generally circular cross section, and it includes a generally oblong frame structure having parallel opposite sides 15 and curved rear member 17. The forward part of the frame of weapon 13 is characterized by a pair of converging arms 19 that join at an apex region 21 from which extends a tip-mounting stem 23 that has a forward end that threadedly attaches a removable sharpened tip 25. Finally, there is a cross member 27 that is affixed between the sides members 15. The structure of device 13 is bilaterally symmetrical about a longitudinal axis 31. The spacing between sides 15 is sufficient to admit the fingers of the user's hands, and the cross bar 27 is spaced from the rear member 17 such that bar 27 can be gripped by one's fingers as the rear member 17 engages the palm of one's hand. Thus it will be appreciated that when device 13 is grasped as a hand held weapon, the converging front arms 19 and the sides 15 will afford protection of one's hands from offensive strikes of an attacker.

Figure 2:
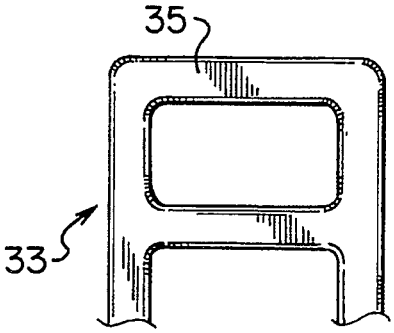
FIG. 2 is a partial top plan view showing a variant of the present invention.

FIG. 2 depicts a variant 33 of the invention that is constructed similarly to device 13, except that its frame members have a generally square cross section, and its rear member 35 is generally straight rather than curved.

Figure 3:
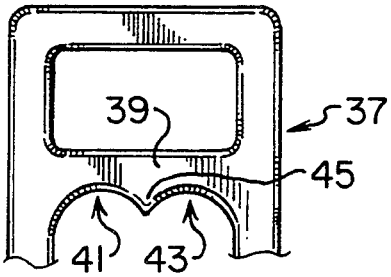
FIG. 3 is a partial top plan view of another variant of the present invention.

FIG. 3 depicts another variant 37 according to the invention, and it is similarly constructed to device 33, except that it uses a cross member 39 that has finger-receiving contours at 41 and 43 separated by a central protuberance 45.

Figure 4:
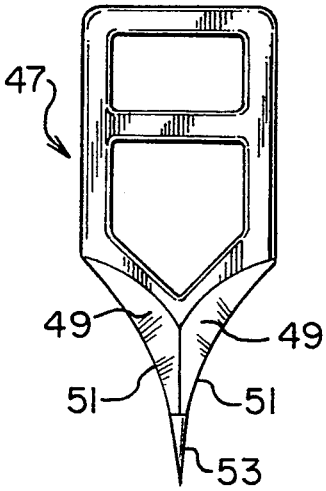
FIG. 4 is a top plan view of yet another preferred embodiment according to the present invention.
Figure 5:
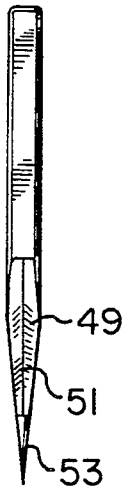
FIG. 5 is a side elevational view of the device of FIG. 4.

FIGS. 4 and 5 show yet another variant of the present invention. This device 47 has enhanced penetrating capability by virtue of its converging arms 49 comprising sharpened blades with edges 51, and a sharpened tip 53. Note that tip 53, like the tips of the other preferred embodiments shown herein is removable, although the invention also contemplates integral permanently affixed tips.

Figure 7:
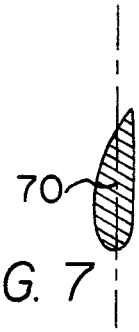
FIG. 7 is a sectional view taken along the line 7—7 of FIG. 8.
Figure 6:
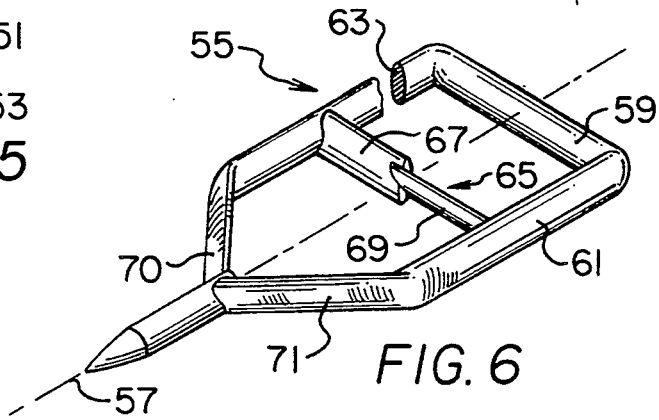
FIG. 6 is a perspective view of an aerodynamically enhanced version of the present invention.
Figure 8:
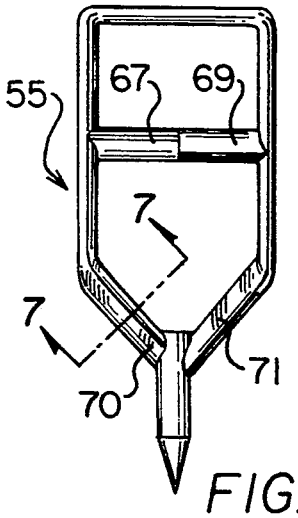
FIG. 8 is a top plan view illustrating the embodiment of FIG. 6.
Figure 9:
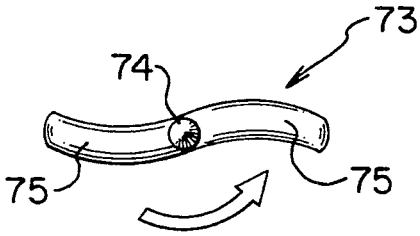
FIG. 9 is a front elevational view of yet another variant of the present invention.

FIG. 6 depicts a variant 55 of the invention that has aerodynamic features which are designed to enhance its performance as a hand propelled throwing weapon. Like the other variants of the invention, weapon 55 is adapted to be hand propelled through the air tip first, and in rotation about its longitudinal axis 57. As FIG. 6 shows weapon 55 has rear frame member 59 and side members 61, these components all having a streamlined oval cross-sectional configuration as indicated by the reference numeral 63. Device 55 is also seen to feature a cross member 65 that has a propeller-like configuration, including first air-foil configured blade 67 that is inclined with respect to a second air-foil configured blade 69. It is further noted that the converging arms 70 and 71 also simulate a propeller-like configuration, albeit a "swept-back" propeller configuration, and the sectional view of FIG. 7 shows them to have a typical lift-generating airfoil shape. It should be appreciated that the chord size, angle-of-attack and other airfoil characteristics of cross member 65 and the converging arms 70 and 71 can be varied to meet the desired performance criteria. It should be appreciated that when a device 55 is rapidly revolved about axis 57 in a clockwise direction, as viewed from the rear of device 55, air will be thrust in a rearward direction. FIG. 9 illustrates another aerodynamically enhanced variant 73 of the invention in front-on perspective. This version includes converging arms 75 and sharpened tip 74 and is constructed similarly to the above-described device 55, except that the device 73 has the somewhat sinusoidal frontal configuration as shown in FIG. 9. This shape is designed to further enhance the aerodynamics of the device when it is revolved in an anti-clockwise direction as viewed in FIG. 9. These aerodynamically enhanced varients are designed for a right-handed person, and it should be evident that the propellor configurations will be reversed for a left-handed person.

When any of the above-described weapons is to be thrown through the air it is grasped with the fingers engaging one of the parallel sides, and the thumb engaging the other side. Then a forceful throwing motion that resembles the motion used to throw a football is used to project the device into rotation about its longitudinal axis in tip-first flight. The rotation will impart a gyroscopic effect to the flying device, and this will provide substantial stability and trueness to the tip-first flight path in which the device is projected. It is also noted that the single tip allows the full momentum and impact force of the projected device to be focused to the tip.

While particular embodiments of the invention have been described herein it should be appreciated that the invention is not limited thereto, there being other varients that will readibly occur to a person of ordinary skill given the benefit of this disclosure. Thus it is intended that the invention be given the full scope and breath as defined by the claims which follow.

What is claimed is:

1. Martial arts throwing and hand-held weapon, said weapon comprising:

a. an oblong frame having a pair of spaced-apart parallel opposite side members, an integral rear bar that connects rear ends of said members, and a forward portion comprising a pair of oblique members that converge from front ends of said side members and connect at an apex;

b. a cross member spaced forwardly of said frame rear bar and extending transversely between said side members, wherein the spacing between said side members is sufficient to admit several fingers of the weapon user, said cross bar being adapted for grasping by the user's fingers and said rear bar adapted to be engaged by the palm of the user's hand;

c. a central stem extending forwardly from said apex; and d. a pointed weapon tip secured to said stem and extending forwardly therefrom.

2. A weapon as defined in claim 1 wherein said frame rear bar has a rounded, curved shape.

3. A weapon as defined in claim 1 wherein said frame rear bar extends straight between the rear ends of said side members.

4. A weapon as defined in claim 1 wherein the structure of said weapon is bilaterally symmetrical about a longitudinal axis through said central stem.

5. A weapon as defined in claim 4 wherein said cross member has a propeller-like airfoil shape that is centered about said longitudinal axis, and whereby said cross member is effective to propel air rearwardly when said weapon is rotated about said axis.

6. A weapon as defined in claim 5 wherein said oblique members have a swept-back propeller-like airfoil shape.

7. A weapon as defined in claim 4 wherein said oblique members have a swept-back propeller-like airfoil shape.

8. A weapon as defined in claim 1 wherein said weapon tip is releasably secured to said stem.

9. A weapon as defined in claim 1 wherein said frame, cross member, and stem, each have a generally circular cross-sectional configuration.

10. A weapon as defined in claim 1 wherein said cross bar has a forward portion that is provided with at least two indentations for engagement by the fingers of a user.

11. A weapon as defined in claim 1 wherein said frame and cross member each have a generally rectangular cross-sectional configuration.

12. A weapon as defined in claim 1 wherein each of said oblique members is a sharpened blade.

* * * * *